US005486500A

United States Patent [19]

Kaufman

[11] Patent Number: 5,486,500

[45] Date of Patent: Jan. 23, 1996

[54] PRINTED TOWEL AND PROCESS

[76] Inventor: Mark S. Kaufman, 200 Ingleside Dr., Stamford, Conn. 06903

[21] Appl. No.: 94,603

[22] Filed: Oct. 20, 1993

Related U.S. Application Data

[63] This application is a continuation of PCT/US93/01979, Mar. 4, 1993, which is a continuation-in-part of Ser. No. 845,717, Mar. 4, 1992, abandoned.

[51] Int. Cl.[6] ..... B41M 5/035; B41M 5/38; D06P 3/54

[52] U.S. Cl. ..... 503/227; 8/471; 428/195; 428/224; 428/245; 428/287; 428/480

[58] Field of Search ..... 8/471; 428/85, 428/196, 197, 88, 89, 195, 224, 245, 287, 480, 913, 914

[56] References Cited

U.S. PATENT DOCUMENTS

| | | | |
|---|---|---|---|
| 3,669,818 | 6/1970 | Stark | 161/63 |
| 3,721,274 | 3/1973 | Sherrill et al. | 139/396 |
| 3,999,939 | 12/1976 | Psaar | 8/2.5 A |
| 4,013,407 | 3/1977 | Ray, Jr. | 8/17 |
| 4,021,591 | 5/1977 | DeVries et al. | 428/200 |
| 4,058,644 | 11/1977 | Devries et al. | 428/200 |
| 4,134,676 | 1/1979 | Mehl | 355/77 |
| 4,231,743 | 11/1980 | Buckwalter et al. | 8/471 |
| 4,251,611 | 2/1981 | Mehl et al. | 430/42 |
| 4,255,150 | 3/1981 | Fennekels et al. | 8/471 |
| 4,265,630 | 5/1981 | Bauerle | 8/456 |
| 4,433,113 | 2/1984 | Woodward et al. | 525/327.5 |
| 4,512,049 | 4/1985 | Henry | 5/417 |
| 4,712,336 | 12/1987 | Backer | 52/71 |
| 4,923,848 | 5/1990 | Akada et al. | 503/227 |
| 5,030,500 | 7/1991 | Perdelwitz, Jr. et al. | 428/137 |

*Primary Examiner*—Margaret Einsmann
*Attorney, Agent, or Firm*—St. Onge Steward Johnston & Reens

[57] ABSTRACT

The present invention relates to a process for providing high definition printing for line art or four color process graphics including reproduction of photographs, on a towel, and involves providing a towel which comprises one face formed of a material able to receive printing by sublimation printing techniques and one face formed of an absorbent material; providing printing on a backing sheet using sublimation inks; and transferring the printing from the backing sheet to the printing receiving face by sublimation of the sublimation inks. The invention also relates to the towel produced thereby.

19 Claims, 1 Drawing Sheet

PRINTED TOWEL AND PROCESS

RELATED APPLICATIONS

This application is a continuation of International Application entitled "Printed Towel and Process", having International Application No. PCT/US93/01979, filed in the name of Kaufman on Mar. 4, 1993; and a continuation-in-part of U.S. patent application entitled "Full-Bleed Printed Towel and Method", having Ser. No. 07/845,717, filed in the name of Kaufman on Mar. 4, 1992, now abandoned the disclosures of each of which are incorporated herein by reference.

TECHNICAL FIELD

The present invention relates to a process for applying high quality printing to towels and like objects, especially beach towels or sports towels. The printing is of a high definition and can even comprise photographic reproductions. The invention also comprises the towels produced thereby.

The production of brilliantly colored towels, especially beach towels or sports towels, has been widely sought. Such items are extremely popular with consumers and are considered commercially very attractive. Current processes for producing printed towels use conventional silk screening techniques, which produce images of relatively low definition, and certainly nothing which has the definition of a photograph. Moreover, there was no known four color process printing (the meaning of which will be apparent to the skilled artisan) technique which would be effective for high quality photograph reproduction on a towel.

In addition, reproduction of multi-colored images and graphics of any definition and quality onto towels was believed to require a border, such that the printing does not extend to the edge of the towel. This difficulty is caused by the fact that the inks or dyes required are considered hazardous for handling and disposal. The production of towels having printing without a border (referred to as full bleed printing), by current techniques, results in a great deal of waste dye which is difficult and expensive to dispose of according to current regulations.

What is desired, therefore, is a process for producing a printed towel which avoids the disadvantages of the prior art and is capable of four color process photo reproduction printing. Preferably, the process also permits full bleed printing.

DISCLOSURE OF INVENTION

The present invention relates to a process for the four color process printing on a towel or like object with sufficient definition to provide photograph reproduction quality and brilliance, while maintaining ample towel absorbency. The skilled artisan would be familiar with the term "photograph reproduction quality and brilliance", which is meant to encompass definition of sufficiently high quality such that no discernible dot pattern is apparent to the naked eye when viewed from twenty-four inches.

The inventive process, in its preferred embodiment, utilizes a towel having an absorbent material on one face and a material which can act as a substrate for printing on another. The printing substrate face of the towel has applied to it printing by sublimation printing techniques which are capable of transferring a high definition design. In fact, using the inventive process, four color process printing has been now found to be possible. Advantageously, the printing applied is full bleed, which has also now been made possible by the inventive process.

DESCRIPTION OF THE DRAWINGS

The invention will be better understood and its advantages will become more apparent from the following detailed description, especially when read in light of the attached drawings, wherein.

DETAILED DESCRIPTION OF THE PREFERRED EMBODIMENT

Figure 1:
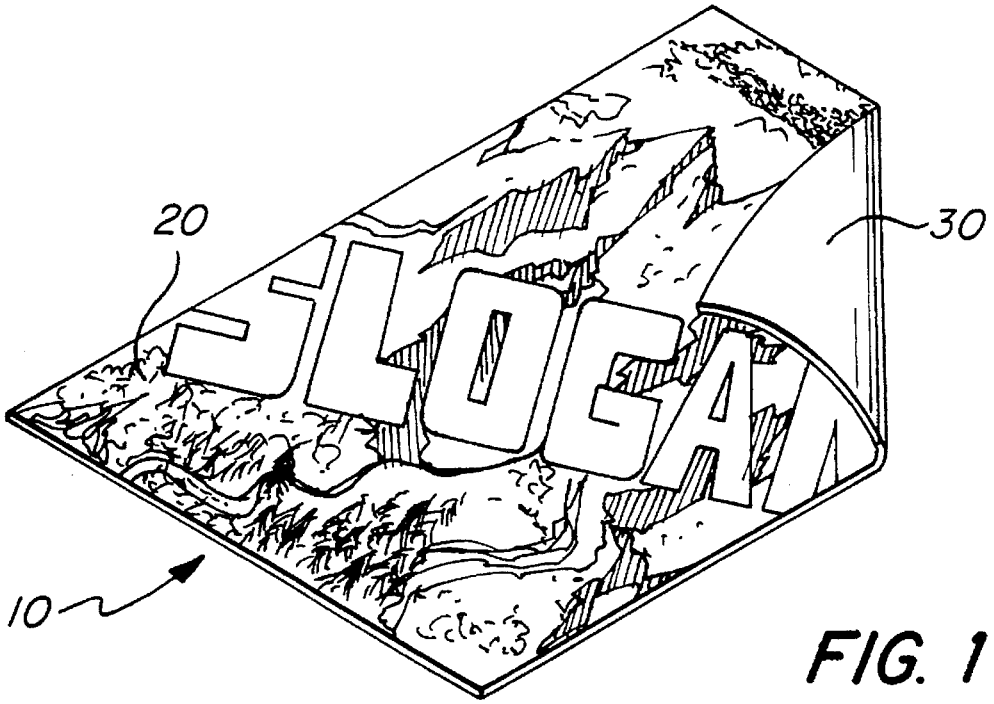
FIG. 1 is a perspective view of the towel of the present invention, having one corner thereof folded over.

Referring to the drawings, a towel in accordance with the invention is generally indicated by the reference numeral 10. It should be noted that for the sake of clarity, all the components and parts of towel 10 are not shown and/or marked in all the drawings. It will also be noted that the present invention is described as towel 10 for the sake of convenience, which is intended to describe its characteristics in addition to its function, and that the invention generally relates to any piece of material useful as a towel and having the desired characteristics. In fact, it is contemplated that any object for which absorbency and ornamentation are desired, such as beach wraps and jackets, are included in the invention, and can be made from towel 10.

Towel 10 used in the process of the present invention is typically made from a web or sheet-like piece of material which can be used for wiping or drying liquids, and comprises two faces or surfaces 20 and 30. Although generally rectangular in shape, as illustrated in FIG. 1, towel 10 can assume any desired shape, such as circular or oval, or can be formed into other objects or garments such as beach wraps or jackets. At least one of faces 20 and 30 of towel 10 of the present invention comprises a printing receiving face, designated hereinafter as 20, that is, a face which receives printing to be applied thereto. Printing receiving face 20 of towel 10 is preferably comprised of a relatively non-absorbent material capable of being dyed in a sublimation printing process (referred to herein as printing receiving material). By relatively non-absorbent is meant that printing receiving material advantageously has a moisture regain of less than about 3%, or about 3/7 that of cotton (moisture regain, for the purposes of this invention refers to the amount of moisture absorbed into the material at 21° C. and 65% relative humidity). Such material preferably comprises polyester, nylon, acrylic, or combinations thereof. Most preferably, printing receiving face 20 of towel 10 comprises polyester.

Although it is not necessary that one hundred percent (100%) of the surface (that is, the area exposed to printing) of printing receiving face 20 comprise the printing receiving material, such as polyester, it is highly desired that as much as possible comprise this material. When the surface of printing receiving face 20 comprises less than one hundred percent of the printing receiving material, image definition on printing receiving face 20 of towel 10 is proportionally less than it would be were printing receiving face 20 made up of one hundred percent of the printing receiving material.

Accordingly, the surface of printing receiving face 20 should preferably comprise at least about 65% of the printing receiving material, such as polyester, and more preferably at least about 80% of printing receiving material. Most preferably, the surface of printing receiving face 20 is at least about 90% printing receiving material and should, in the most preferred embodiment of the present invention, be 100% printing receiving material.

Face 30, opposite printing receiving face 20, of towel 10 should comprise a material capable of absorbing liquids thereinto. Such material can be any natural or synthetic material capable of absorbing liquids thereinto and is preferably a material commonly used in the production of towels, such as cotton or linen. In order to provide sufficient absorbency on this absorbent face 30 of towel 10, the absorbent material should have a moisture regain of at least about 3% (at 21° C., 65% relative humidity) and more advantageously, a moisture regain of at least about 5.5%. Most preferred for use as the absorbent material for towel 10 of the present invention is cotton.

Although it is not necessary that all of absorbent face 30 comprise the absorbent material, it is desired that as much as possible be absorbent material to provide towel 10 with as much absorbency as possible. In fact, the net moisture regain of absorbent face 30 should be at least about 3.5%, more preferably at least about 5.5%. For instance, if 70% of absorbent face 30 by weight is cotton, having a moisture regain of 7%, the remaining material should have a moisture regain of at least about 2% to provide a net moisture regain of 5.5% (70%×7% plus 30%×2%=5.5%).

Alternatively, if there is no need for towel 10 to have absorbency (i.e., for example, when its purpose is for a picnic towel or other application where it is acting as a protectant, but not an absorbing medium), both faces 20 and 30 can comprise printing receiving material. In this way, printing can be applied to either or both faces 20 and 30. However, for the sake of simplicity, towel 10 will be described herein as having both printing receiving face 20 and absorbent face 30.

Figure 2:
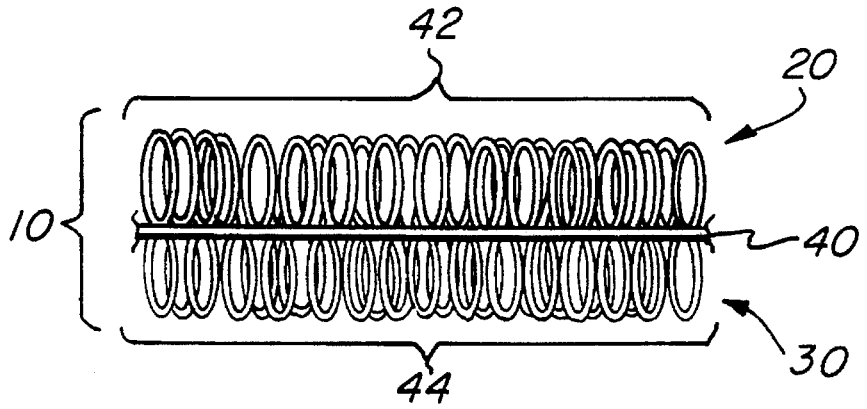
FIG. 2 is a broken-away, cross-section view of the towel of FIG. 1.

Towel 10 used in the present invention can be prepared by any conventional method known to those skilled in the towel-making art. Most commonly, towel 10 is prepared by knitting or weaving the desired materials together so as to form a sheet of material having faces 20 and 30, at least one of which is printing receiving face 20 as described above. As illustrated in FIG. 2, a typical towel prepared according to the present invention comprises a spine or warp 40 which comprises a web of material from which extends on either side loops of material, the loops 42 on printing receiving face 20 comprising loops of printing receiving material. The loops 44 on face 30 preferably comprise loops of absorbent material, as described above. Depending on the process used to prepare towel 10, warp 40 can comprise printing receiving material, absorbent material, or a combination of both.

Figure 3:
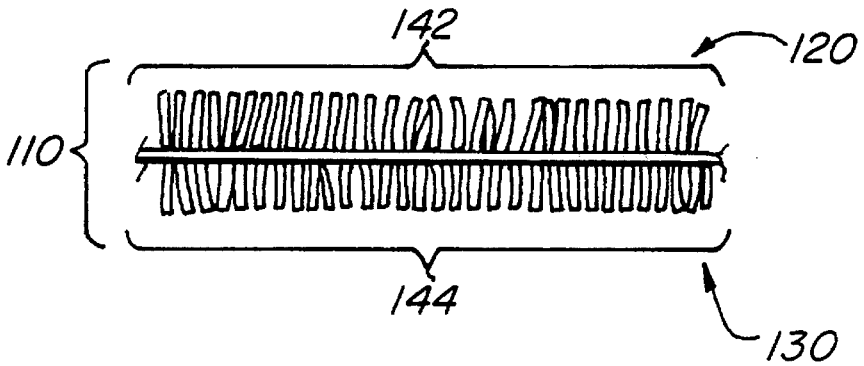
FIG. 3 is a broken-away, cross section view of an alternate embodiment of the towel of the present invention.

As is apparent, the side on which loops 44 of absorbent material extend comprises absorbent face 30, and the side on which loops 42 of printing receiving material extend comprise printing receiving face 20. In an alternate embodiment denoted as 110, illustrated in FIG. 3, printing receiving face 120 comprises strands 142 of printing receiving material, and absorbent face 130 comprises strands 144 of absorbent material. Strands 142 and 144 are formed from loops 42 of printing receiving material and loops 44 of absorbent material, respectively, which have been sheared by conventional techniques to result in a "velour"-like surface. In addition, one face of towel 10 can comprise strands and the other face loops, as desired.

When formed as described above, printing receiving face 20 of towel 10 has sufficient number of loops 42 or strands 142 of printing receiving material such that printing provided by sublimation printing techniques to printing receiving face 20 will have the desired degree of definition and brilliance.

Towel 10 can be formed with the printing receiving and/or absorbent materials in any desired color, although it is preferred that both the absorbent material and the printing receiving material used to form printing receiving face 20 and absorbent face 30 be either white or uncolored material so as to provide for the highest possible definition and brilliance of the printing applied to printing receiving face 20.

As noted above, printing is applied to printing receiving face 20 by sublimation printing techniques. The printing can be line art or four color process graphics including reproduction of photographs; it can comprise lettering, images, or combinations of the two, as illustrated in FIG. 1. Sublimation printing techniques involve the printing of a design on a paper backing sheet by conventional printing techniques. They employ sublimation inks which are then transferred under heat and pressure to printing receiving face 20 of towel 10. Such techniques are described by DeVries and Snyder, in U.S. Pat. Nos. 4,021,591 and 4,058,644, the disclosures of each of which are incorporated herein by reference.

The backing sheet used for the sublimation printing of towel 10 can be formed of any material provided it is dimensionally stable and can withstand the heat of sublimation printing, which generally ranges between about 100° C. and about 300° C. Suitable materials include polyesters such as polyethylene terephthalate, polyamides, polycarbonates, paper such as parchment, fiberglass cloth, a cross-linked phenol-formaldehyde resin, thin metal foil, woven or non-woven fabrics, cross-linked urea-formaldehyde resins, glassine paper, cellulose esters, fluorene polymers such as polyvinylidene fluoride or polytetrafluoroethylene, polyethers, polyolefins, polyacetals, and polyamides.

The backing sheet most often has a thickness between about 2 and about 30 microns and can also be coated with a subbing layer if desired. Moreover, the backing sheet can also include a slipping layer comprising a lubricating material on the reverse side of the printed side to prevent sticking to the sublimation printing apparatus.

The backing sheet has printing applied to it using sublimation inks. Such inks, although appearing somewhat dull and off-colored when printed on the backing sheet, produce brilliant and high definition designs when transferred to towel 10. The printing applied to the backing sheet can be any desired printing and can include four color photo reproductions. The inks used in applying the printing to the backing sheet for transfer to towel 10 comprise any sublimable dyes, including disperse dyes, basic dyes, and dye formers of basic dyes which are present in an organic base sublimation ink or a water soluble sublimation ink. The inks can also comprise a thickener such as a water soluble colloid or a hydrophobic material and the like, as well as water. The amount of dye used in the sublimation ink is determined by the depth of shade required for the particular printing.

Suitable sublimation inks for use herein are described in U.S. Pat. No. 4,058,644. Indeed, virtually any sublimable ink is suitable for use for the present invention. Exemplary of such inks are those containing dyes such as CI #54 Latyl 3G (yellow), CI #25 Latyl NST (orange), CI #1 acetamine B (red), CI #28 Latyl 2R(B) and CI #2 Latyl MS (brown), each of which is available from E. I. Dupont Company.

Examples of commercially available sublimation inks include the sinvatherm line of inks including NW 8380 (blue), NW 6587 (magenta), NW 6586 (yellow), and NW 7814 (black), distributed by Sinclair and Valentine and Company and the Lithotex line of inks such as V-0194 (blue), V-5044 (magenta), V-5008 (yellow), and V-0245 (black), distributed by Colonial Ink Company.

The printing can be applied to the backing sheet using conventional printing techniques, including offset printing, lithographic, photographic, and silk screening techniques. Preferably, in order to achieve the highest possible definition, the images are applied to the backing sheet using the sublimable ink by photographic or lithographic techniques.

Once the printing is formed on the backing sheet, it is transferred to printing receiving face 20 of towel 10 by conventional sublimation techniques, which involve the application of heat along with pressure or vacuum to transfer the sublimation dyes from the backing sheet to printing receiving face 20.

As illustrated in FIG. 1, when printing receiving face 30 is printed by sublimation, the printing can be full-bleed printing, that is, it can extend to the border, which is a preferred embodiment of the invention, because of the nature of sublimation printing techniques which permit the backing sheet to be closely aligned with the substrate towel 10 for sublimation printing. More importantly, sublimation printing techniques permit the application of high definition printing to printing receiving face 30 and allow printing in a plurality of colors, including four color process printing (including photographs) previously thought unobtainable. By this process very high definition, brilliant printing can be achieved, and it can even be achieved full bleed, on towel 10.

Once printed, towel 10 can be used to form various articles, such as beach jackets, beach wraps, etc. by conventional methods.

The above description is for the purpose of teaching the person of ordinary skill in the art how to practice the present invention, and it is not intended to detail all of those obvious modifications and variations of it which will become apparent to the skilled worker upon reading the description. It is intended however, that all such obvious modifications and variations be included within the scope of the present invention which is defined by the following claims.

What is claimed is:

1. A printed towel having two faces, a first face comprising a print receiving face which comprises at least about 65% of a relatively non-absorbent material able to receive printing by sublimation printing techniques, wherein said relatively non-absorbent material comprises a material selected from the group consisting of polyester, nylon, acrylic or combinations thereof, said print receiving face having four color process printing applied thereon by sublimation of sublimation inks; and a second face comprising an absorbent material having a net moisture regain of at least about 3.5%.

2. The towel of claim 1, wherein the printing receiving face has a moisture regain of less than about 3%.

3. The towel of claim 2, wherein the printing receiving face of said towel is comprised of polyester.

4. The towel of claim 3, wherein said first face comprises at least about 90% polyester.

5. The towel of claim 1, wherein said printing is formed by photographic or lithographic techniques.

6. The towel of claim 1, wherein said towel is formed by providing a web of material having absorbent material extending therefrom on one side thereof and printing receiving material extending therefrom or another side thereof.

7. The towel of claim 1, wherein said absorbent material comprises cotton.

8. The towel of claim 1, wherein said printing comprises lettering, images, or combinations thereof.

9. The towel of claim 8, wherein said printing is produced full bleed.

10. A printed towel having two faces, a first face comprising a print receiving face which comprises at least about 65% of a relatively non-absorbent material having a moisture regain of less than about 3% and able to receive printing by sublimation printing techniques, said relatively non-absorbent material comprising polyester, wherein said print receiving face has four color process printing applied thereon full bleed by sublimation of sublimation inks; and a second face comprising an absorbent face which comprises cotton, having a net moisture regain of at least about 3.5%.

11. A process for making a towel having photographic reproduction quality and brilliance printing thereon, comprising a) providing a towel having two faces, i. a first face comprising a printing receiving face which is comprised of at least about 65% of a relatively non-absorbent material able to receive printing by sublimation printing techniques, wherein said relatively non-absorbent material comprises a material selected from the group consisting of polyester, nylon, acrylic or combinations thereof; and ii. a second face comprising an absorbent face which is comprised of an absorbent material having a net moisture regain of at least about 3.5%;

b) providing printing on a backing sheet using sublimation inks; and c) transferring the printing from the backing sheet to the printing receiving face of said towel by sublimation of said sublimation inks.

12. The process of claim 11, wherein the printing receiving face of said towel material is comprised of polyester.

13. The process of claim 12, wherein said first face comprises 90% polyester.

14. The process of claim 11, wherein said printing is formed on said backing sheet by photographic or lithographic techniques.

15. The process of claim 11, wherein said towel material is formed by providing a web of material having absorbent material extending therefrom on one side thereof and printing receiving material extending therefrom on another side thereof.

16. The process of claim 11, wherein the absorbent face of said towel material has a net moisture regain of at least about 3.5%.

17. The process of claim 15, wherein said absorbent material comprises cotton.

18. The process of claim 11, wherein said printing comprises lettering, images, or combinations thereof.

19. The process of claim 18, wherein said printing is produced full bleed.

* * * * *

UNITED STATES PATENT AND TRADEMARK OFFICE

CERTIFICATE OF CORRECTION

PATENT NO. : 5,486,500

DATED : January 23, 1996

INVENTOR(S) : Mark S. Kaufman

It is certified that error appears in the above-indentified patent and that said Letters Patent is hereby corrected as shown below:

At Column 1, line 11, insert -- , -- immediately after "now abandoned".

Signed and Sealed this

Twenty-third Day of April, 1996

*Attest:*

Bruce Lehman

BRUCE LEHMAN

*Attesting Officer*

*Commissioner of Patents and Trademarks*